US006332729B1

(12) United States Patent
Koreska

(10) Patent No.: US 6,332,729 B1
(45) Date of Patent: Dec. 25, 2001

(54) PEN-SHAPED LIQUID APPLICATOR

(75) Inventor: Peter Koreska, Vienna (AT)

(73) Assignee: Kores Holding Zug AG, Zug (CH)

( * ) Notice: Subject to any disclaimer, the term of this patent is extended or adjusted under 35 U.S.C. 154(b) by 0 days.

(21) Appl. No.: 09/529,878

(22) PCT Filed: Sep. 23, 1998

(86) PCT No.: PCT/AT98/00231

§ 371 Date: Apr. 21, 2000

§ 102(e) Date: Apr. 21, 2000

(87) PCT Pub. No.: WO99/20148

PCT Pub. Date: Apr. 29, 1999

(30) Foreign Application Priority Data

Oct. 22, 1997 (AT) ..... 1784/97

(51) Int. Cl.[7] ..... A47L 13/30
(52) U.S. Cl. ..... 401/263; 401/264; 401/265
(58) Field of Search ..... 401/263, 264, 401/265, 266, 261

(56) References Cited

U.S. PATENT DOCUMENTS

| | | | | |
|---|---|---|---|---|
| 1,730,655 | * | 10/1929 | Hayes | 401/264 |
| 2,550,832 | | 5/1951 | Loeffler . | |
| 2,714,475 | | 8/1955 | Roehrich . | |
| 2,921,324 | * | 1/1960 | Gibbons | 401/263 |
| 3,229,866 | * | 1/1966 | Arbitman et al. | 401/263 |
| 3,256,551 | | 6/1966 | Schwartzman . | |
| 3,400,997 | * | 9/1968 | Schwartzman | 401/265 |
| 3,545,874 | * | 12/1970 | Schwartzman | 401/264 |
| 4,201,491 | * | 5/1980 | Kohler | 401/264 |
| 5,176,293 | | 1/1993 | Weiler . | |
| 5,743,441 | | 4/1998 | Baudin et al. . | |

FOREIGN PATENT DOCUMENTS

| | | | | |
|---|---|---|---|---|
| 464520 | | 5/1946 | (BE) . | |
| 545205 | | 1/1974 | (CH) . | |
| 382755 | * | 10/1923 | (DE) | 401/264 |
| 2635609 | | 3/1979 | (DE) . | |
| 2730669 | | 5/1979 | (DE) . | |
| 245983 | | 11/1987 | (EP) . | |
| 753465 | | 1/1997 | (EP) . | |
| 753466 | | 1/1997 | (EP) . | |
| WO 87/00487 | | 1/1987 | (WO) . | |

* cited by examiner

*Primary Examiner*—David J. Walczak
(74) *Attorney, Agent, or Firm*—Pillsbury Winthrop LLP Intellectual Property Group

(57) ABSTRACT

A pen-shaped applicator (1) for applying a liquid, in particular glue, on a substrate comprises a container (2) out of which the liquid can be pressed and a dosing part (6) arranged on one end face of the container (2) and having a dispensing layer (8) with openings for the liquid. A spring-loaded valve body (13) with which a valve seat (12) is associated is arranged inside the dispensing layer (8). The dispensing layer (8) is made of plastics and formed in a single piece with the dosing part (6), in particular by injection molding.

25 Claims, 1 Drawing Sheet

PEN-SHAPED LIQUID APPLICATOR

BACKGROUND OF THE INVENTION

1. Field of the Invention

The invention relates to a pen-shaped applicator for applying a liquid, e.g. glue, to a substrate, which applicator comprises a container out of which said liquid can be pressed and a dosing part arranged on one end face of said container and having a dispensing layer with openings for said liquid inside which a spring-loaded valve body is arranged with which a valve seat is associated.

2. Prior Art

In such commercially available pen-shaped applicators for applying glue a relatively soft tissue of synthetic fibers is used as a dispensing layer which is attached in a ring gap of the dosing part. After long-term use of these pen-shaped applicators, however, said tissue in its holding means in the ring gap may loosen or may even come entirely loose so that the glue to be applied can not be uniformly distributed any more or may even leak out at the side of the loosened synthetic tissue. Moreover, a major disadvantage is that said tissue is an extra component of said pen-shaped applicator for applying glue, which component has to be specially produced and attached in an extra assembly step.

Further, from EP-A 753 465 and EP-A 753 466 application devices for cosmetics are known wherein at the dispensing end a domed, rigid wall with outlets is provided carrying a membrane having staggered openings. This membrane usually closes the outlets in the rigid wall but will be lifted from it if pressure is applied to the cosmetic product contained so that said product may be dispensed through said staggered openings. Thus, these known application devices, too, are rather expensive and complicated to produce, and with regard to the membrane closing mechanism they would not be suitable for dispensing glue because glue would stick the membrane and the wall together.

SUMMARY OF THE INVENTION

An object of the invention is to create a pen-shaped applicator of the type as described above which avoids the disadvantages of the known pen-shaped applicators and devices and which is, in particular, easy to produce.

According to the invention, this object is reached by forming, preferably injection molding the dispensing layer of plastics in a single piece with the dosing part. The dosing part may be produced together with the dispensing layer in a simple manner, e.g. by injection molding, so that the dispensing layer need not be attached separately, and, moreover, as they are formed in a single piece, the dispensing layer can not loosen or become entirely loose. Surprisingly it has been found that uniform application of such liquids as particularly glues may be achieved by means of such a generally grid-shaped dispensing layer. The dispensing layer is formed as a more or less foil-like, grid- or sieve-shaped platelet with openings which is injection molded in a single piece with the dosing part. The dosing part itself may be formed in a single piece with the container, but for easier attachment of the valve body it is preferably a separate e.g.sleeve-shaped part arranged on one end face of or in the e.g. generally cylindrical container as known per se.

In a favorable embodiment a plurality of outward-oriented projections are located on the outside of the dispensing layer. These projections, which may have the shape of burls or small pins, on the one hand allow uniform distribution of the liquid or glue and, on the other hand, being resiliently yielding, they result in a soft touch and good, easy gliding of the pen-shaped applicator on the substrate. For exactly directed application it is also suitable to provide through openings for the liquid between the projections only in a central part of the dispensing layer. Moreover, for a comfortable feeling like "writing" the projections are advantageously of cylindrical or conical shape and have rounded ends.

It is of particular advantage to make the dosing part with the dispensing layer of HDPE. On the one hand, this allows the dispensing layer to deform resiliently when the liquid is applied, and, on the other hand, this ensures mechanical strength for long-time use.

As the platelet-like dispensing layer made of plastics yields slightly inward as a rule due to the pressure of pressing down when the liquid is applied, this inward deformation may be used to operate the valve. Accordingly, and for dispensing exact doses of glue, it is of particular advantage that said valve seat, which e.g. has the shape of a truncated cone, for the spring-loaded valve body designed complementary therewith is formed in a single piece at the inside of the dispensing layer and the valve body has a projection located in the middle of the side facing the dispensing layer, which projection just touches the dispensing layer in the closed position of the valve formed by the valve seat and the valve body. If the pen-shaped applicator with the dispensing layer is pressed down, the dispensing layer will move inward, resulting in the valve body also moving inward over its projection and thus being lifted up from the valve seat so that the valve is opened.

It may also be of advantage that the valve body is formed in a single piece with the spring which is supported by one or more supporting projections in the dosing part. This allows easy production by means of injection molding techniques. Moreover, it is easier to assemble because only one single part has to be handled.

With regard to a useful life for as long as possible it has proven favorable that the valve body and the spring are made of polyacetate. This material shows virtually no signs of fatigue and is therefore particularly suitable for the movable valve body and the spring formed thereon.

Finally, in order to store and distribute the liquid it is advantageous that the dispensing layer has burl-like projections formed on its inside.

BRIEF DESCRIPTION OF THE DRAWINGS

Hereinafter, the present invention will be described in greater detail with reference to preferred examples to which the invention shall not be restricted, however.

DETAILED DESCRIPTION OF PREFERRED EMBODIMENTS OF THE INVENTION

Figure 1:
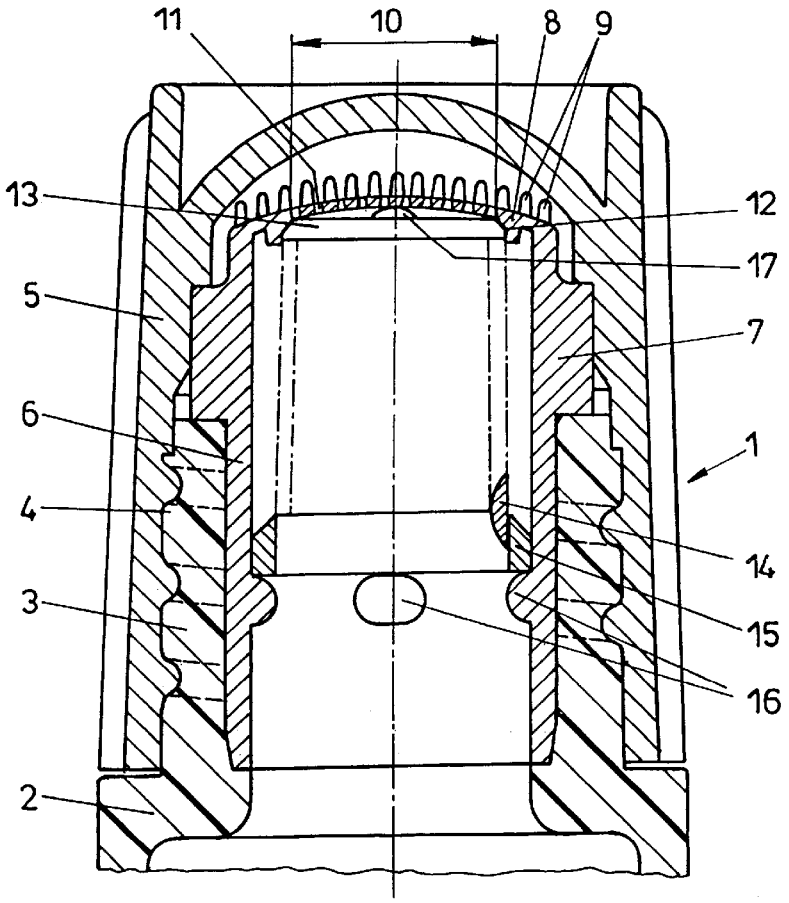
FIG. 1 shows a longitudinal section through the tip region of a pen-shaped applicator for applying liquid glue.

The pen-shaped applicator 1 for applying liquid glue shown in FIG. 1 comprises a generally cylindrical container 2, only partly shown in the figure, made of resiliently deformable plastics material which is filled with glue. The upper end of container 2 has the shape of a tapering neck 3 having a screw thread 4 for a closure cap 5. A dosing part 6 for dosed dispensing of the glue from container 2, or rather its neck 3 when container 2 is compressed for use, is inserted in neck by means of force fit.

Figure 2:
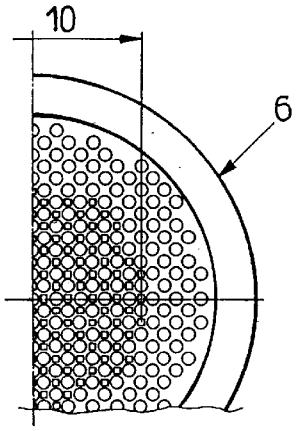
FIG. 2 shows a top view, partially broken away, of the dosing part of the pen-shaped applicator of FIG. 1.

Dosing part 6, which is formed as an insert, also consists of resilient plastics material, preferably HDPE (high density polyethylene); in its upper section it has a head rim 7 which constitutes a stop to the end of neck 3 on the one hand and a stop for cap 5 on the other hand. Above head rim 7, dosing part 6 turns into an outward-domed dispensing layer 8 having a plurality of upward-oriented cylindrical or conical pin projections 9 distributed in the form of a grid across its entire outer side, with the free ends of the projections being rounded. In a central circular region 10 of dispensing layer 8, which defines the area of passage for the glue, square-shaped through openings 11 for the glue are provided between adjacent pins 9 resulting in a circular grid or sieve platelet (see FIG. 2). A valve seat 12 having the shape of a truncated cone for a valve body 13 complementary formed therewith is formed on the underside of dispensing layer 8 and outside central circular region 10; this valve body 13 is formed in a single piece with a pre-loaded spring 14 and also consists of resilient plastics material, preferably polyacetate. The lower end of spring 14, which is preferably a triple threaded helical spring, adjoins a ring 15 which is supported by four supporting burl projections 16 formed on the inner wall of dosing part 6.

On its side facing dispensing layer 8, valve body 13 has a centrally located, rounded button projection 17 which just touches the underside of dispensing layer 8 in the closed position of the valve formed by valve seat 12 and valve body 13 as shown in FIG. 1.

If, during use of the pen-shaped applicator, dispensing layer 8 is pressed on a substrate to which glue is to be applied, dispensing layer 8 and thus button 17 and valve body 13 are pressed into the opened position of the valve against the force of spring 14 so that glue passes via the valve and through openings 11 of dispensing layer 2 and may be distributed over an area by means of pin-like projections 9 arranged on the outside of dispensing layer 8.

Figure 3:
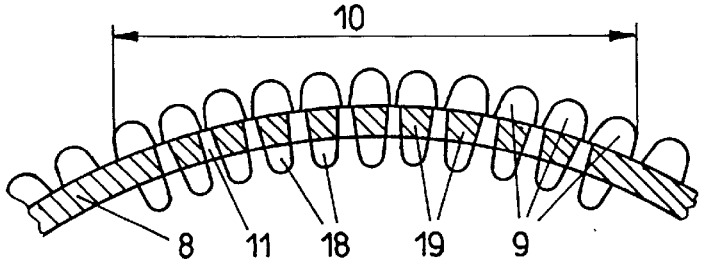
FIG. 3 shows a partial section through the dispensing layer in a modified embodiment.

According to FIG. 3 e.g. burl-like, rounded projections 18 may be formed on the inside of dispensing layer 8 which help store and distribute the liquid to be dispensed.

Tests have shown that the size of openings 11 may be e.g. 0.3 mm×0.3 mm (on the outside of dispensing layer 8); the outer projections are about 1 mm in diameter at their circular base area and about 1 to 1.5 mm in height. The webs 19 (see FIG. 3) between openings 11 are e.g. about 1 mm wide.

Of course, grid shapes with different distances and opening shapes, such as circular openings 11, may be contemplated as well. Moreover, it is also conceivable to form valve seat 12 on the side of the inner wall of dosing part 6, and three, six, etc. projections instead of the four supporting projections may be provided, or only one collar-shaped surrounding projection may be provided. Dosing part 6 itself could also be formed in a single piece with container 2 as long as it has a suitable, closable inlet (not shown) at its back end.

What is claimed is:

1. A pen-shaped applicator for applying a liquid to a substrate, said applicator comprising:

a container from which said liquid can be pressed and a dosing part arranged on one end face of said container, said dosing part including a dispensing layer integrally formed with the dosing part as a single piece, said dispensing layer having openings therein to permit passage of said liquid; and a spring-loaded valve body disposed within the dosing part in association with a valve seat disposed on one side of the dispensing layer, and wherein a plurality of projections being integrally formed on an opposite side of the dispensing layer.

2. A pen-shaped applicator for applying a liquid to a substrate, said applicator comprising:

a container from which said liquid can be pressed and a dosing part arranged on one end face of said container, said dosing part including a dispensing layer integrally formed with the dosing part as a single piece, said dispensing layer having openings therein to permit passage of said liquid; and a spring-loaded valve body disposed within the dosing part in association with a valve seat disposed on one side of the dispensing layer, said dosing part and dispensing layer being made of an injection molded plastic, and wherein a plurality of projections are integrally formed on an opposite side of the dispensing layer.

3. A pen-shaped applicator for applying a liquid to a substrate, said applicator comprising:

a container from which said liquid can be pressed and a dosing part arranged on one end face of said container, said dosing part including a dispensing layer integrally formed with the dosing part as a single piece, said dispensing layer having openings therein to permit passage of said liquid; and a spring-loaded valve body disposed within the dosing part in association with a valve seat disposed on one side of the dispensing layer, wherein said dosing part and dispensing layer are made of an injection molded plastic, and wherein said valve seat is formed integrally with the dispensing layer, and complementary to the valve body, and wherein the valve body has a projection located substantially in the middle of one side of the valve body facing the dispensing layer, said valve body projection just touching the dispensing layer in a closed position of a valve formed by the valve seat and the valve body.

4. A pen-shaped applicator for applying a liquid to a substrate, said applicator comprising:

a container from which said liquid can be pressed and a dosing part arranged on one end face of said container, said dosing part including a dispensing layer integrally formed with the dosing part as a single piece, said dispensing layer having openings therein to permit passage of said liquid; and a spring-loaded valve body disposed within the dosing part in association with a valve seat disposed on one side of the dispensing layer, wherein said dosing part and dispensing layer are made of an injection molded plastic, and wherein said one side of the dispensing layer is provided with a plurality of burl-like projections.

5. A pen-shaped applicator according to claim 1 or 2, wherein said openings in the dispensing layer are located between said projections in a central area of the dispensing layer.

6. A pen-shaped applicator according to claim 5, wherein said projections are of cylindrical shape and have rounded ends.

7. A pen-shaped applicator according to claim 5, wherein said projections are of conical shape and have rounded ends.

8. A pen-shaped applicator according to claim 1 or 2, wherein said projections are of cylindrical shape and have rounded ends.

9. A pen-shaped applicator according to claim 1 or 2, wherein said projections are of conical shape and have rounded ends.

10. A pen-shaped applicator for applying a liquid to a substrate, said applicator comprising:

a container from which said liquid can be pressed and a dosing part arranged on one end face of said container, said dosing part including a dispensing layer integrally formed with the dosing part as a single piece, said dispensing layer having openings therein to permit passage of said liquid; and a spring-loaded valve body disposed within the dosing part in association with a valve seat disposed on one side of the dispensing layer, wherein said valve seat is formed integrally with the dispensing layer and complementary to the valve body, and wherein the valve body has a projection located substantially in the middle of one side of the valve body facing the dispensing layer, said valve body projection just touching the dispensing layer in a closed position of a valve formed by the valve seat and the valve body.

11. A pen-shaped applicator according to claim 10 or 3, wherein said dosing part and dispensing layer are made of an injection molded plastic.

12. A pen-shaped applicator according to claim 11, wherein said valve body is formed in a single piece with a spring which is supported by at least one supporting projection provided within said dosing part.

13. A pen-shaped applicator according to claim 11, wherein said dosing part and dispensing layer are made of HDPE.

14. A pen-shaped applicator according to claim 10 or 3, wherein a plurality of additional projections are integrally formed on an opposite side of the dispensing layer.

15. A pen-shaped applicator according to claim 14, wherein said openings in the dispensing layer are located between said additional projections in a central area of the dispensing layer.

16. A pen-shaped applicator according to claim 15, wherein said additional projections are of cylindrical shape and have rounded ends.

17. A pen-shaped applicator according to claim 15, wherein said additional projections are of conical shape and have rounded ends.

18. A pen-shaped applicator according to claim 14, wherein said additional projections are of cylindrical shape and have rounded ends.

19. A pen-shaped applicator according to claim 14, wherein said additional projections are of conical shape and have rounded ends.

20. A pen-shaped applicator according to claim 10 or 3, wherein said valve seat has the shape of a truncated cone.

21. A pen-shaped applicator according to claim 20, wherein said valve body and said spring are made of polyacetate.

22. A pen-shaped applicator according to claim 10 or 3, wherein said valve body is formed in a single piece with a spring which is supported by at least one supporting projection provided within said dosing part.

23. A pen-shaped applicator according to claim 22, wherein said valve body and said spring are made of polyacetate.

24. A pen-shaped body for applying a liquid to a substrate, said applicator comprising:

a container from which said liquid can be pressed and a dosing part arranged on one end face of said container, said dosing part including a dispensing layer integrally formed with the dosing part as a single piece, said dispensing layer having openings therein to permit passage of said liquid; and a spring-loaded valve body disposed within the dosing part in association with a valve seat disposed on one side of the dispensing layer, wherein said one side of the dispensing layer is provided with a plurality of burl-like projections.

25. A pen-shaped body according to claim 10 or 3, wherein said one side of the dispensing layer is provided with a plurality of burl-like projections.

* * * * *